US012421719B2

(12) United States Patent
Burt et al.

(10) Patent No.: US 12,421,719 B2
(45) Date of Patent: Sep. 23, 2025

(54) DECK FRAMING SYSTEM

(71) Applicant: Fortress Iron, LP, Garland, TX (US)

(72) Inventors: Kevin T. Burt, Dallas, TX (US); Matthew Carlyle Sherstad, Dallas, TX (US); Kevin B. Flatt, Garland, TX (US); Aaron Jesiolowski, Garland, TX (US); Geoff T. Luczycki, Garland, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

(21) Appl. No.: 18/179,131

(22) Filed: Mar. 6, 2023

(65) Prior Publication Data

US 2023/0203810 A1 Jun. 29, 2023

Related U.S. Application Data

(63) Continuation of application No. 17/378,220, filed on Jul. 16, 2021, now Pat. No. 11,598,090, which is a (Continued)

(51) Int. Cl.
*E04B 5/10* (2006.01)
*E04B 1/00* (2006.01)
(Continued)

(52) U.S. Cl.
CPC ..... *E04B 5/10* (2013.01); *E04B 1/003* (2013.01); *E04B 1/2403* (2013.01); *E04C 3/005* (2013.01);
(Continued)

(58) Field of Classification Search
CPC ..... E04B 5/10; E04B 1/003; E04B 1/2403; E04B 2001/2415; E04B 2001/2439;
(Continued)

(56) References Cited

U.S. PATENT DOCUMENTS 2,106,084 A 1/1938 Coddington
2,744,590 A 5/1956 Butts
(Continued)

FOREIGN PATENT DOCUMENTS

JP 2004-245043 A 9/2004
JP 2004-339923 A 12/2004
WO WO-2004/022875 3/2004

OTHER PUBLICATIONS

International Search Report and Written Opinion for PCT/US2017/055158 dated Jan. 23, 2018 (15 pages).

*Primary Examiner* — Beth A Stephan
(74) *Attorney, Agent, or Firm* — Foley & Lardner LLP; John J. May

(57) ABSTRACT

A deck framing system includes a perimeter support member that has a joist support wall and a web wall extending perpendicularly from the joist support wall and an overhang wall extending perpendicularly from the web wall. First and second joist support brackets include a joist support portion and a pair of attachment wings, where each one of the pair of attachment wings contacting the web wall of the perimeter support member. First and second joists each include a deck support wall and a lower wall. The deck support walls of the first and second joists are disposed between the overhang wall and the joist support portions, and the lower walls are disposed between the joist support portions and the joist support wall.

18 Claims, 16 Drawing Sheets

Related U.S. Application Data continuation of application No. 16/779,000, filed on Jan. 31, 2020, now Pat. No. 11,066,830, which is a continuation of application No. 16/123,661, filed on Sep. 6, 2018, now Pat. No. 10,550,570, which is a continuation of application No. 15/725,003, filed on Oct. 4, 2017, now Pat. No. 10,100,516.

(60) Provisional application No. 62/404,616, filed on Oct. 5, 2016.

(51) Int. Cl.

| | |
|---|---|
| ***E04B 1/24*** | (2006.01) |
| ***E04C 3/00*** | (2006.01) |
| ***E04C 3/06*** | (2006.01) |
| ***E04C 3/07*** | (2006.01) |
| ***E04C 3/09*** | (2006.01) |
| *E04C 3/04* | (2006.01) |

(52) U.S. Cl.
CPC ..... *E04C 3/065* (2013.01); *E04C 3/07* (2013.01); *E04C 3/09* (2013.01); *E04B 2001/2415* (2013.01); *E04B 2001/2439* (2013.01); *E04B 2001/2466* (2013.01); *E04C 2003/046* (2013.01); *E04C 2003/0465* (2013.01); *E04C 2003/0482* (2013.01)

(58) Field of Classification Search
CPC .. E04B 2001/2466; E04C 3/005; E04C 3/065; E04C 3/07; E04C 3/09; E04C 2003/046; E04C 2003/0465; E04C 2003/0482; F16B 7/105
See application file for complete search history.

(56) References Cited

U.S. PATENT DOCUMENTS

| | | | | |
|---|---|---|---|---|
| 2,966,708 | A | 1/1961 | Freeman, Jr. | |
| 2,990,921 | A | 7/1961 | Wilde | |
| 3,592,493 | A | 7/1971 | Goose | |
| 3,717,964 | A | 2/1973 | Brown | |
| 3,751,870 | A | 8/1973 | Vesei | |
| 3,906,328 | A | 9/1975 | Wenrich et al. | |
| 3,945,741 | A | 3/1976 | Wendt | |
| 4,007,570 | A | 2/1977 | Hunter et al. | |
| 4,047,348 | A | 9/1977 | Mcsweeney et al. | |
| 4,114,861 | A | 9/1978 | Long | |
| 4,197,952 | A | 4/1980 | De Fouw et al. | |
| 4,236,688 | A * | 12/1980 | Wilk | F16L 3/08 248/217.1 |
| 4,250,679 | A | 2/1981 | Burg | |
| 4,253,210 | A | 3/1981 | Racicot | |
| 4,560,301 | A | 12/1985 | Gilb | |
| 4,596,101 | A | 6/1986 | Brinker | |
| 4,606,801 | A | 8/1986 | Prestridge et al. | |
| 4,608,801 | A | 9/1986 | Green et al. | |
| 4,660,799 | A | 4/1987 | Butland | |
| 4,894,967 | A | 1/1990 | Morton | |
| 5,004,369 | A | 4/1991 | Young | |
| 5,189,857 | A | 3/1993 | Herren et al. | |
| 5,190,268 | A | 3/1993 | Espinueva | |
| 5,217,124 | A * | 6/1993 | Stone | A47F 5/005 211/184 |
| 5,217,317 | A | 6/1993 | Young | |
| 5,274,973 | A | 1/1994 | Liang | |
| 5,533,696 | A * | 7/1996 | Laughlin | F16L 3/12 248/74.1 |
| 5,596,859 | A | 1/1997 | Horton et al. | |
| 5,657,596 | A | 8/1997 | Powers, III | |
| 5,667,181 | A * | 9/1997 | van Leeuwen | E04B 9/18 52/39 |
| 5,857,306 | A | 1/1999 | Pellock | |
| 5,956,916 | A | 9/1999 | Liss | |
| D423,325 | S | 4/2000 | Liss | |
| 6,167,675 | B1 | 1/2001 | Leblanc | |
| 6,176,053 | B1 | 1/2001 | St. Germain | |
| 6,301,854 | B1 | 10/2001 | Daudet et al. | |
| 6,332,299 | B1 | 12/2001 | Stewart, III | |
| 6,418,694 | B1 | 7/2002 | Daudet et al. | |
| 6,427,416 | B1 | 8/2002 | Rassel | |
| D463,575 | S | 9/2002 | Daudet et al. | |
| 6,536,179 | B2 | 3/2003 | Little | |
| 6,672,545 | B1 * | 1/2004 | Persing | F16L 3/1211 248/58 |
| 6,691,478 | B2 | 2/2004 | Daudet et al. | |
| 6,691,487 | B2 | 2/2004 | Daudet | |
| 6,705,056 | B2 | 3/2004 | Tollenaar | |
| 6,761,005 | B1 | 7/2004 | Daudet et al. | |
| 6,826,884 | B2 | 12/2004 | Pabedinskas et al. | |
| 6,843,035 | B1 | 1/2005 | Glynn | |
| 7,127,862 | B2 | 10/2006 | Saldana | |
| 7,134,252 | B2 | 11/2006 | Thompson | |
| 7,240,459 | B2 | 7/2007 | Daudet et al. | |
| 7,257,930 | B2 | 8/2007 | Aldykiewicz, Jr. et al. | |
| 7,428,804 | B2 | 9/2008 | Surowiecki | |
| 7,451,575 | B2 | 11/2008 | Hall et al. | |
| 7,603,814 | B1 * | 10/2009 | Hartmann | G09F 7/18 52/27 |
| 7,735,294 | B2 | 6/2010 | Moody et al. | |
| 7,739,850 | B2 | 6/2010 | Daudet | |
| 7,743,578 | B2 | 6/2010 | Edmondson | |
| 7,856,786 | B2 | 12/2010 | Beck et al. | |
| 7,975,446 | B2 | 7/2011 | Hall et al. | |
| 8,011,160 | B2 | 9/2011 | Rice | |
| 8,424,266 | B2 | 4/2013 | Edmondson | |
| 8,973,333 | B2 | 3/2015 | Sugihara et al. | |
| D730,545 | S | 5/2015 | Stauffer et al. | |
| 9,777,479 | B2 | 10/2017 | Rice | |
| 9,932,734 | B1 | 4/2018 | Winter | |
| 10,066,384 | B1 | 9/2018 | Hendry | |
| 10,100,516 | B2 * | 10/2018 | Burt | E04C 3/005 |
| 10,125,801 | B2 * | 11/2018 | Wilson | F16B 7/042 |
| 10,132,074 | B2 | 11/2018 | Pace | |
| 10,174,498 | B2 | 1/2019 | Winter | |
| 10,370,842 | B2 | 8/2019 | Wesney et al. | |
| 10,526,796 | B1 | 1/2020 | Way | |
| 10,550,570 | B2 * | 2/2020 | Burt | E04B 1/2403 |
| 11,066,830 | B2 * | 7/2021 | Burt | E04C 3/09 |
| 11,598,090 | B2 * | 3/2023 | Burt | E04C 3/005 |
| 2002/0078645 | A1 | 6/2002 | Meyer | |
| 2004/0200172 | A1 | 10/2004 | Beck et al. | |
| 2005/0188638 | A1 | 9/2005 | Pace | |
| 2006/0048470 | A1 | 3/2006 | Edmondson | |
| 2006/0091372 | A1 * | 5/2006 | Rosian | E04F 11/1817 256/65.01 |
| 2006/0096229 | A1 | 5/2006 | Serpico et al. | |
| 2006/0185312 | A1 | 8/2006 | Weeks | |
| 2006/0191236 | A1 | 8/2006 | Surowiecki | |
| 2008/0022624 | A1 | 1/2008 | Hanson et al. | |
| 2008/0066409 | A1 | 3/2008 | Pruitt | |
| 2008/0237421 | A1 | 10/2008 | Szpotowski | |
| 2008/0256884 | A1 | 10/2008 | Clarizia et al. | |
| 2009/0139176 | A1 | 6/2009 | Schroeder et al. | |
| 2010/0083606 | A1 | 4/2010 | Davis et al. | |
| 2012/0297710 | A1 | 11/2012 | Klein | |
| 2012/0297724 | A1 | 11/2012 | Pope et al. | |
| 2013/0067850 | A1 | 3/2013 | Sasanecki | |
| 2013/0139465 | A1 | 6/2013 | Kuryk et al. | |
| 2014/0144098 | A1 | 5/2014 | Nicholls et al. | |
| 2016/0002934 | A1 | 1/2016 | Morsching | |
| 2016/0186424 | A1 | 6/2016 | Meyer | |
| 2018/0094432 | A1 | 4/2018 | Burt et al. | |
| 2023/0228080 | A1 | 7/2023 | Allen | |

* cited by examiner

DECK FRAMING SYSTEM

PRIORITY CLAIM

Pursuant to 35 U.S.C. § 120, this application is a continuation of U.S. patent application Ser. No. 17/378,220, filed Jul. 16, 2021, now pending, which is a continuation of U.S. patent application Ser. No. 16/779,000, filed Jan. 31, 2020, now U.S. Pat. No. 11,066,830, which is a continuation of U.S. patent application Ser. No. 16/123,661, entitled "Deck Framing System," filed Sep. 6, 2018, now U.S. Pat. No. 10,550,570, which is a continuation of U.S. patent application Ser. No. 15/725,003, entitled "Deck Framing System," filed Oct. 4, 2017, now U.S. Pat. No. 10,100,516, which claims the benefit of U.S. Provisional Patent Application No. 62/404,616, entitled "Deck Framing System," filed Oct. 5, 2016, the disclosures of which are incorporated by reference.

TECHNICAL FIELD

The present disclosure relates to construction materials, and more particularly to a deck framing system formed of light gauge steel components.

BACKGROUND

Most outdoor deck frames are assembled using conventional building techniques and are typically formed of treated lumber. However, deck frames made of light gauge steel are an option for a sturdy and durable outdoor deck. Steel frames supporting a deck surface made of composite material, as opposed to natural wood, may be particularly durable. An example deck frame formed of light gauge steel is disclosed in U.S. Pat. No. 6,691,478 to Daudet et al. filed on May 14, 2002, entitled "Joist Support Apparatus," which is hereby incorporated by reference. Typically, light gauge steel ledgers support joists with a height of eight or twelve inches. Also, oftentimes brackets are attached to an outer surface of the joists and to the ledger using hardware. In certain instances, the one end of a bracket may be integral to the ledger. Attachment of such brackets can be cumbersome and increase time and difficulty in assembling a deck frame. Ease of assembly and strength of the deck frame assembly can be improved.

SUMMARY

Embodiments of the present disclosure include a deck framing system formed of light gauge steel. The thickness of the light gauge steel components may be different among particular components depending on the load carried by the particular component and depending on the forming method for fabrication of the particular component. The deck framing system includes a ledger in which bracket slots are formed. The bracket slots are spaced apart from each other along a length of the ledger. Each bracket slot receives a joist support bracket. The joist support brackets are received from a rear of the ledger such that the joist support brackets engage a rear surface of the ledger and are disposed between the ledger and the support structure to which the ledger is attached. Each of the joist support brackets are received within an end of a joist. According to certain embodiments, the joists are generally in a closed box-like shape. The deck surface is laid on top of and supported by the joists.

Technical advantages of a light gauge steel deck framing system according to the teachings of the present disclosure include a simplified assembly where the joist support brackets are secured to the ledger without conventional fasteners. In addition, the joist support bracket and the ledger are configured to support a joist in position where conventional fasteners are used to secure the joists to the joist support brackets. This represents an improvement over conventional steel deck framing systems with cumbersome bracket configurations where the joist must be held in place by workers until the fasteners are applied to join the joist to the brackets.

Other technical advantages will be readily apparent to one of ordinary skill in the art from the following figures, descriptions, and claims. Moreover, while specific advantages have been described above, various embodiments may include all, some, or none of the enumerated advantages.

BRIEF DESCRIPTION OF THE DRAWINGS

A more complete understanding of the present invention may be acquired by reference to the following Detailed Description when taken in conjunction with the accompanying Drawings wherein.

DETAILED DESCRIPTION OF THE DRAWINGS

Figure 1A:
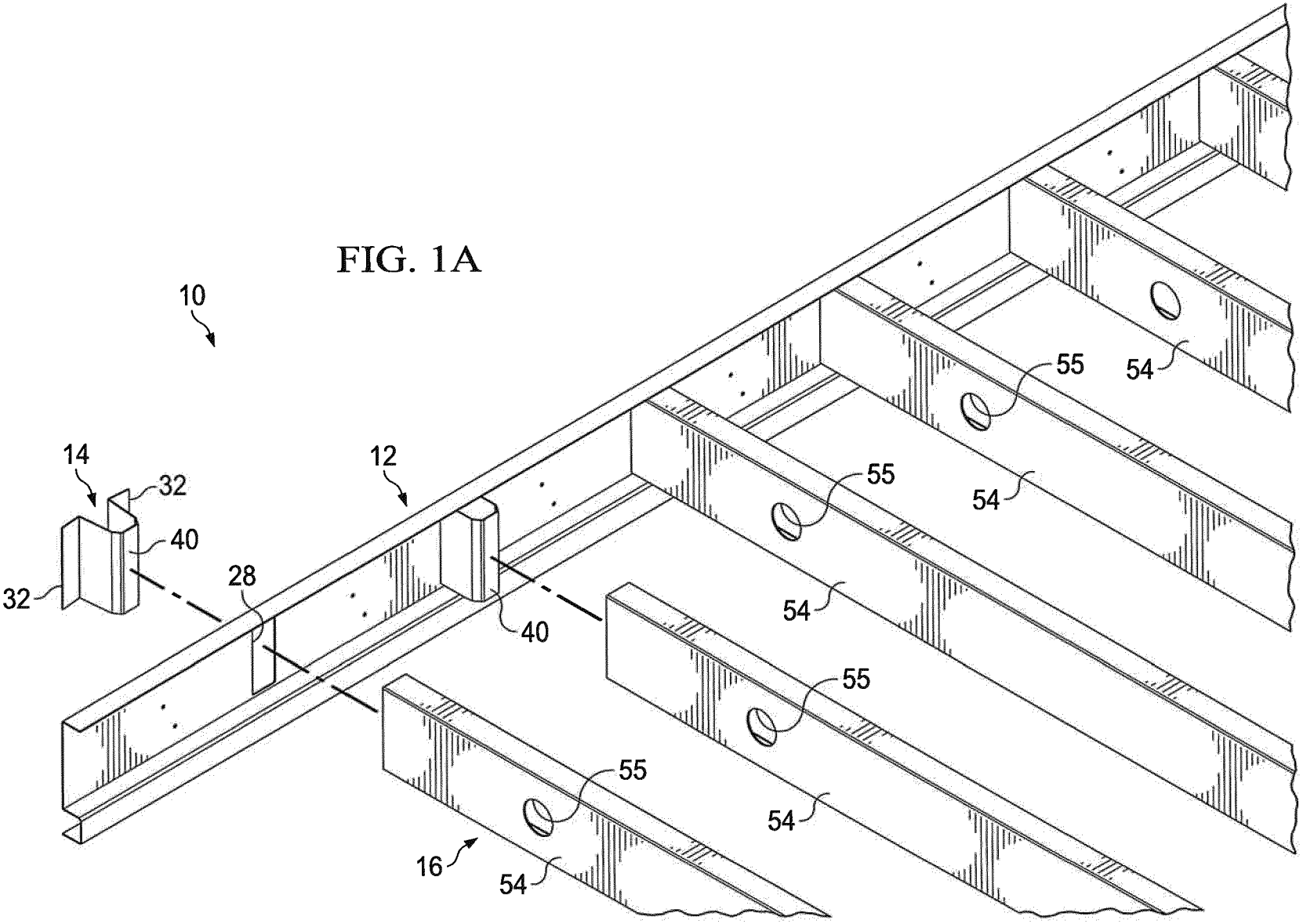
FIGS. 1A-1B are isometric, partially exploded views of a deck framing system with certain components exploded to better illustrate the assembly of the system according to an embodiment of the present disclosure.
Figure 1B:
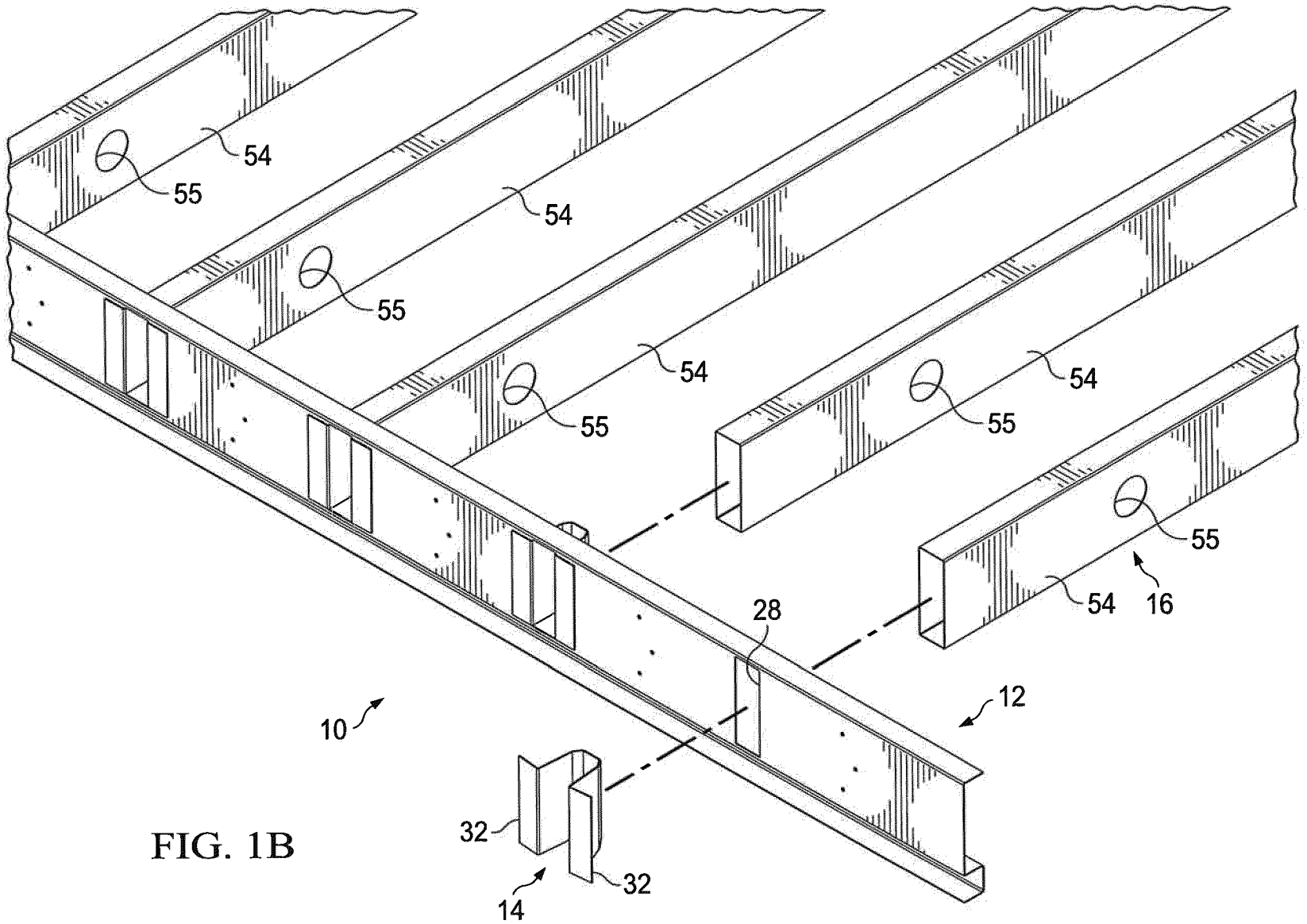
Figure 2A:
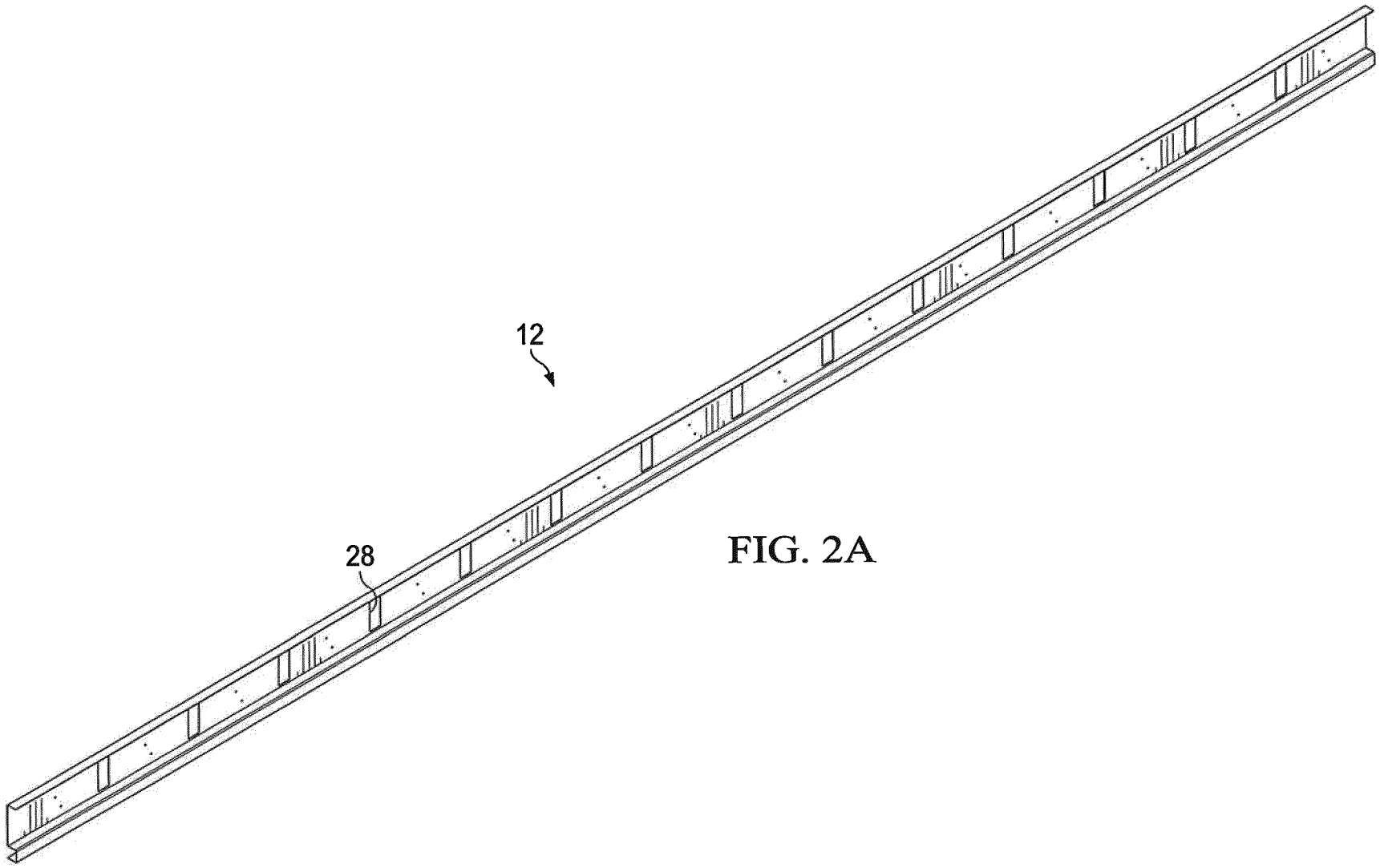
FIGS. 2A-2D are various views of a slotted ledger of the deck framing system of FIGS. 1A-1B.
Figure 2B:
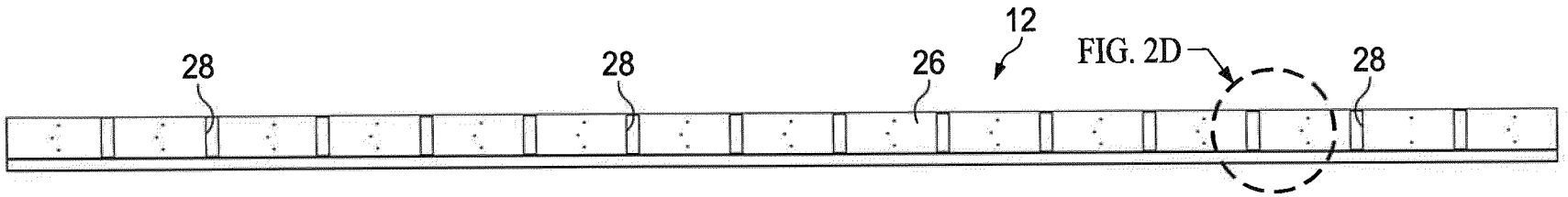
Figure 2D:
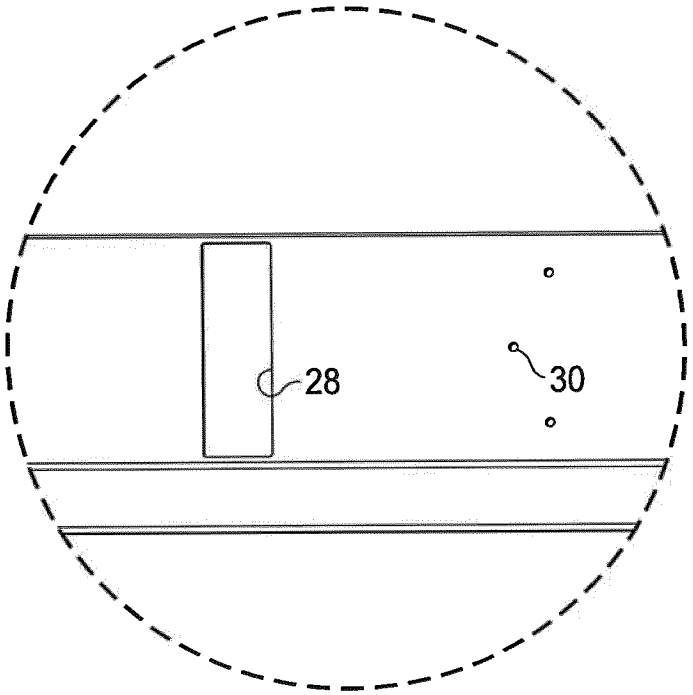
Figure 2C:
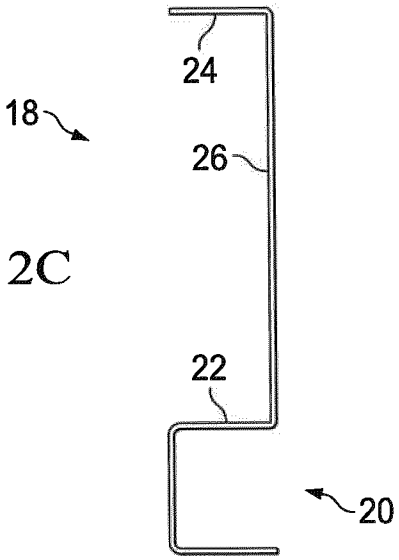

FIGS. 1A and 1B are perspective views of a deck framing system 10 according to an embodiment of the present disclosure. The deck framing system 10 includes features that increase ease of assembly of the deck framing system 10 and increase structural strength of individual components and thereby allow for less material to be used to frame a deck. According to certain embodiments, the deck framing system is made of a light gauge steel. For example, the light gauge steel may be a galvanized steel with a thickness in the range of 0.05-0.10 inches, for example 0.08 inches.

The deck framing system 10 includes a ledger 12, a plurality of joist brackets 14 (also referred to as square joist brackets 14) and a plurality of joists 16. Each of the ledger 12, the joist brackets 14, and the joists 16 are formed of light gauge steel, for example galvanized steel. An end of the joists opposite the ledger may be supported by a second ledger, a beam, a rim joist, or other support structure that is known in the art.

Reference is now made to FIGS. 2A-2D, which illustrate different views of the ledger 12. The ledger 12 has a generally s-shaped profile. The s-shape is generally formed by an upper c-shaped portion 18 and a lower c-shaped portion 20. A joist support wall 22 is disposed generally horizontal and forms a lower part of the upper c-shaped portion 18 and an upper part of the lower c-shaped portion 20. The upper c-shaped portion 18 includes an overhang 24, a web wall 26 extending downward from the overhang wall 24 and the joist support wall 22 opposite the web wall 26 from the overhang wall 24. An opening of the "c" of the upper c-shaped portion 18 faces opposite an opening of the "c" of the lower c-shaped portion 20.

A plurality of bracket slots 28 are formed in the web wall 26. The bracket slots 28 are generally rectangular and have a long dimension that is approximately equal to a height of the web wall 26. The bracket slots 28 are equally spaced apart from each other along the length of the web wall 26. In one embodiment, the bracket slots 28 are approximately twelve inches from a center of one bracket slot 28 to a center of an adjacent bracket slot 28. However, any spaced apart dimension suitable for supporting a particular type of deck material and expected load is contemplated by the present disclosure. For example, bracket slots 28 and therefore joists 16 may be spaced apart 8-24 inches, for example 16 inches.

The ledger 12 is attached to a structure, such as a foundation, bricks, wall studs, and the like of a home. According to certain embodiments, a suitable fastener, such as a screw is received through a preformed hole 30 in the web wall 26. Sets of three preformed holes 30 are located along the length of the web wall 26 to ensure that the ledger is tightly secured to the structure. A set of three holes 30 is spaced apart from an adjacent set of three holes 30 approximately sixteen inches. According to certain embodiments, a center hole 30 may be slightly offset, for example offset one inch, from vertical alignment with the other two preformed holes 30, which are vertically aligned with each other. The aligned two holes of the set of three holes 30 may be generally centered between two adjacent bracket slots 28. The offset hole configuration may avoid creating a stress concentration area in the location of the preformed holes 30 and more evenly distribute loading stresses across the length of the ledger 12. Each of the preformed holes 30 may have any suitable diameter for receiving an appropriate fastener. For example, each of the preformed holes has a diameter in a range of 0.1-0.5 inches, such as 0.25 inches.

According to one embodiment, a height of the web wall 26 is slightly over six inches. This may be an improvement over conventional ledgers where a height of a web wall is approximately 10 inches. The reduced height to approximately six inches allows the upper c-shaped portion 18 supporting the joists 16 to be more rigid and less likely to bend under the weight of the deck supported by the joists 16.

The lower c-shaped portion 20 provides an area underneath the joists 16 to run electrical wiring and the like and provides clearance beneath the joists 16. The lower c-shaped portion 20 also increases the strength of the ledger 12 and also provides a spring force when the ledger 12 is loaded.

The ledger 12 may be generally formed by sheet metal forming methods known in the art, such as bending a flat piece of light gauge steel in to the s-shape profile and removing material from the steel to form the bracket slots 28 by, for example, stamping to shear the portion of the steel to be removed. The holes 30 may or may not be preformed in the web wall 26. A height of the s-shaped ledger 12 is approximately eight inches. The ledger 12 may be formed in any suitable length, for example the ledger 12 may be 20 feet in length.

Before securing the ledger 12 to the structure, the joist brackets 14 are received from the rear of the ledger 12 through the bracket slots 28. (See FIGS. 1A-1B). Reference is now made to FIGS. 3A-3D, which are multiple views of the joist bracket 14 according to the teachings of the present disclosure. The joist bracket 14 allows a tube joist to be received in perpendicular orientation with respect to the ledger 12. In other words, the square joist bracket 14 supports a tube joist 16 in square alignment with the ledger 12.

The square joist bracket 14 includes a pair of wing walls 32 and a joist support portion 34. The joist support portion 34 is received through the bracket slot 28 to extend beyond a front surface of the web wall 26 of the ledger 12, and the wings engage a rear surface of the web wall 26. The joist support portion 34 extends approximately three inches from the web wall 26 of the ledger 12. In this manner, the joist bracket 14 may be secured to the ledger 12 without using fasteners as are used in conventional deck framing systems. In particular, an expanding spring force created by compressing opposed lateral portions 36 of the joist bracket 14 toward each other provides a force against the ledger 12 to secure the joist bracket 14 to the ledger 12 without additional fasteners. Moreover, the wings 32 of the joist bracket 14 are disposed between the structure and the ledger 12 and therefore the structure also serves to hold the joist bracket 14 in place within the bracket slot 28 of the ledger 12.

The pair of opposed lateral walls 36 are each delimited at one end by a wing 32 and delimited at an opposite end by an angled wall 38. Each angled wall 38 is delimited at one end by a lateral wall 36 and at an opposite end by a bracket web 40. According to certain embodiments, the bracket web 40 is generally parallel to the web wall 26 of the ledger 12.

Figure 3A:
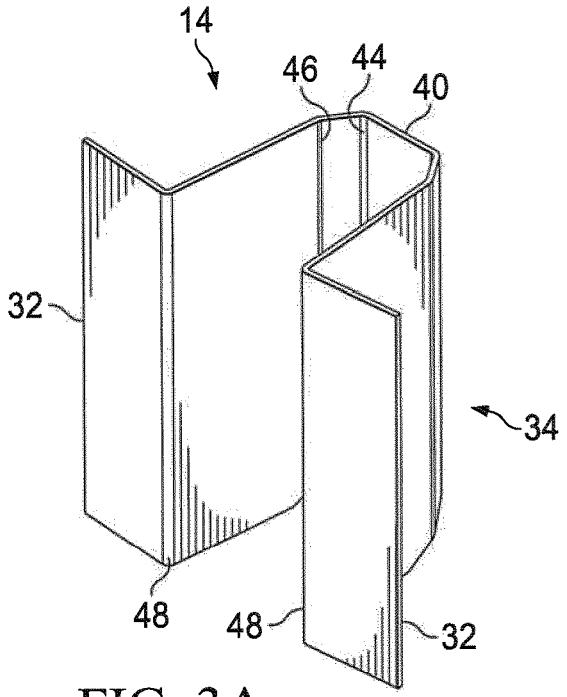
FIGS. 3A-3D are various views of a square joist support bracket of the deck framing system shown in FIGS. 1A-1B.
Figure 3B:
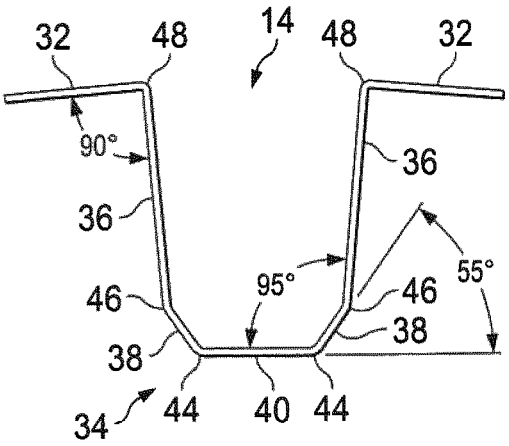
Figure 3C:
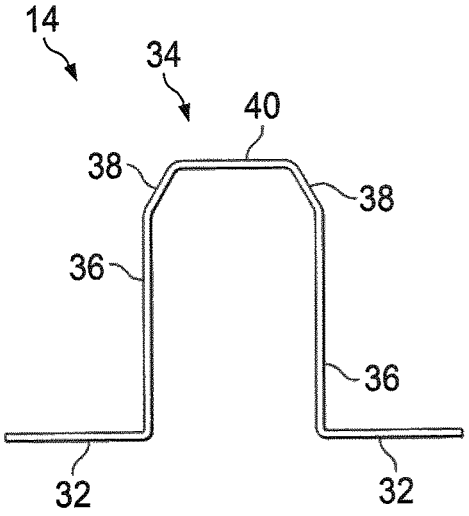

Reference is made to FIG. 3B, which is a top view of the square joist bracket 14 in a relaxed configuration. In the relaxed configuration, the opposed lateral walls 36 are not parallel to each other. Rather, an angled extension of approximately ten degrees from parallel creates a spring force to secure the joist bracket 14 within the bracket slot 28 in the ledger 12. Reference is made to FIG. 3C, which illustrates a top view of the joist bracket 14 in a compressed configuration. In the compressed configuration, the lateral walls 36 of the joist bracket 14 are held compressed by the walls of the bracket slot 28 of the ledger 12 to be parallel to each other. The lateral walls 36 are biased toward their expanded relaxed configuration and thereby create a force against the walls of the bracket slot 28 in the ledger 12.

Figure 3D:
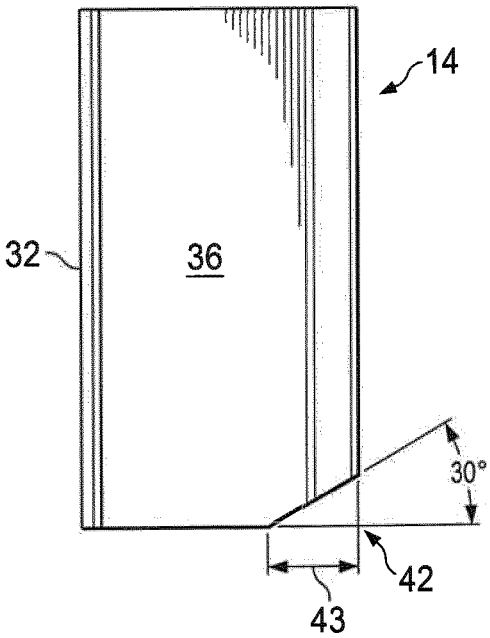
Figure 4A:
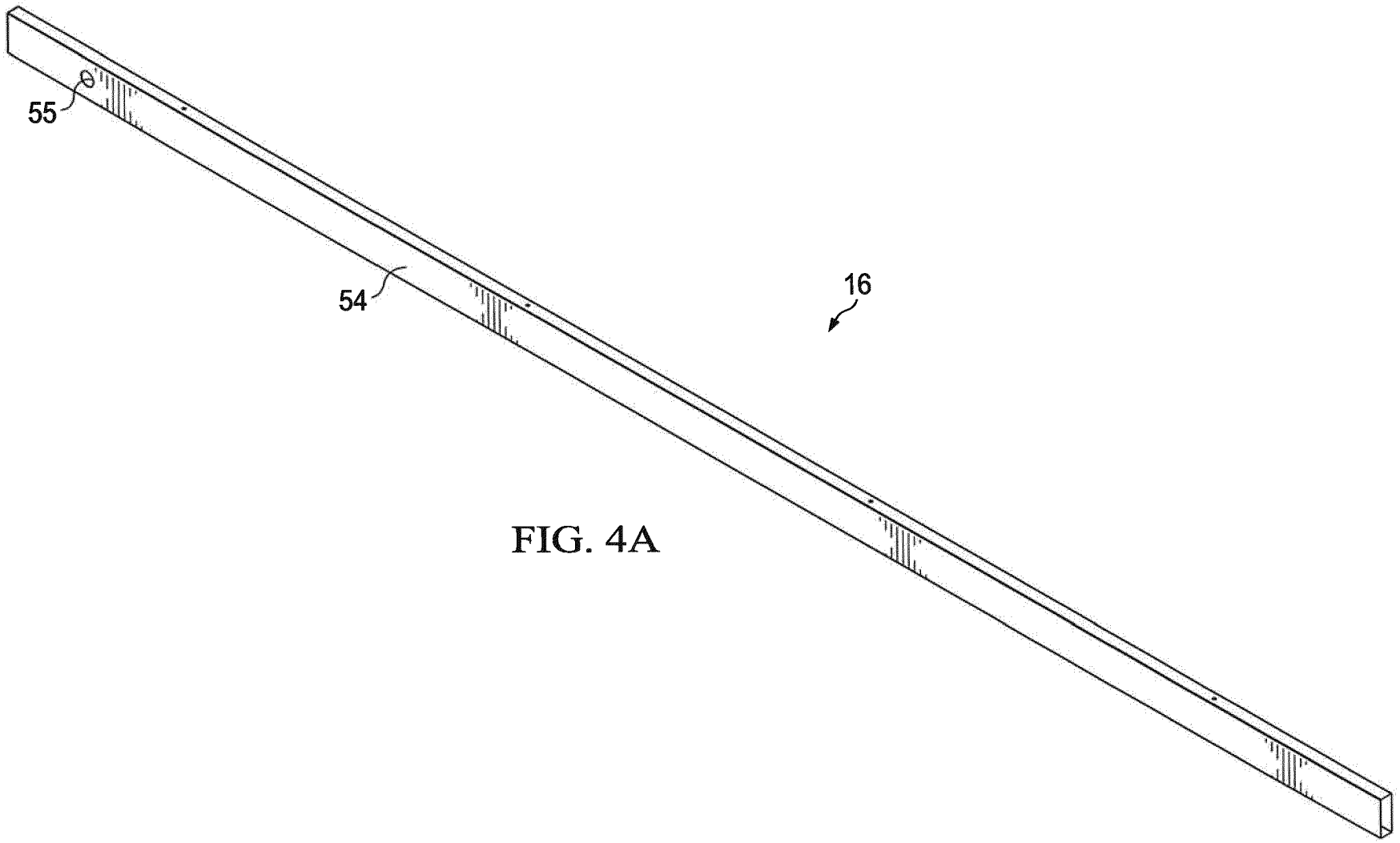
FIGS. 4A-4E are various views of a tube joist of the deck framing system shown in FIGS. 1A-1B.
Figure 4B:
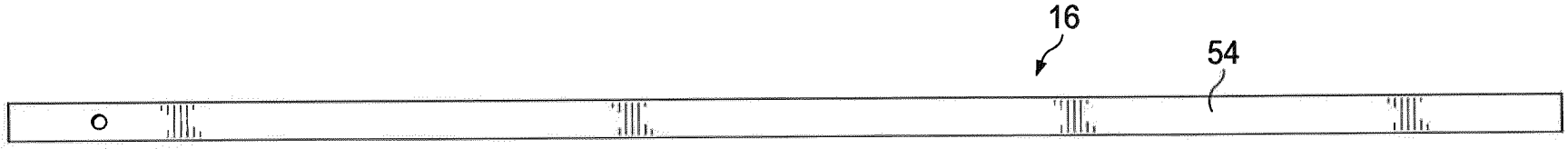
Figure 4C:
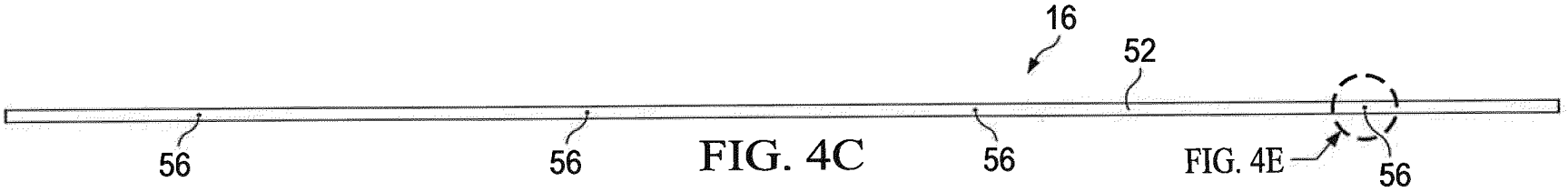
Figure 4E:
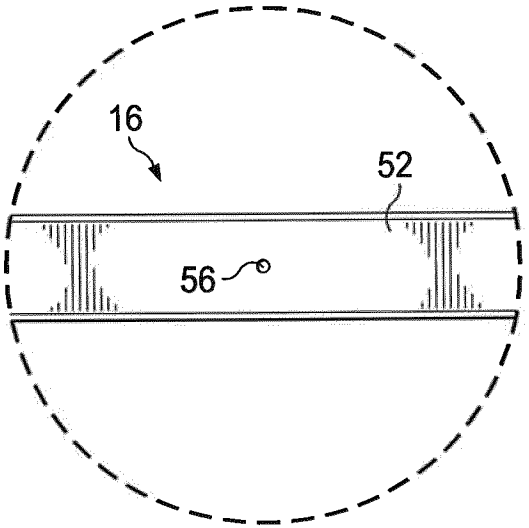
Figure 4D:
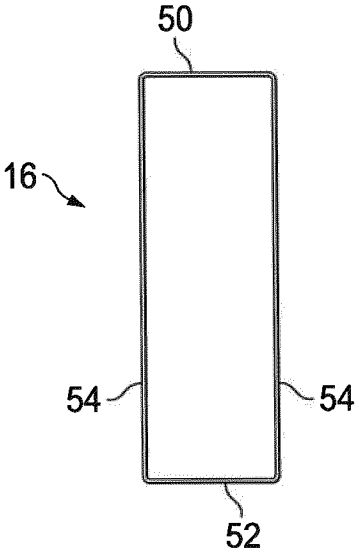

Reference is made to FIG. 3D, which illustrates a side view of the square joist bracket 14. A lower cut-away 42 is formed by removing material from a lower portion of the bracket web 40, the angled walls 38, and the lateral walls 36. According to certain embodiments, the cut-away 42 is approximately thirty degrees from horizontal and extends into the joist bracket 14 a distance 43 of approximately one inch. As described in more detail below, the cut-away 42 facilitates placement of the joist 16 over the joist support portion 34 of the joist bracket 14.

According to one embodiment, the joist bracket 14 has a height of slightly less than six inches such that it fits within the bracket slot 28 of the ledger 12.

The square joist support bracket 14 is formed by folding a flat piece of sheet metal to form the joist bracket 14 in the relaxed configuration shown in FIG. 3B. The sheet metal is folded along an angled portion fold line 44 approximately 55 degrees with a radius of approximately 0.1 inches to form the angled wall 38. The sheet metal is folded along a pair of lateral portion fold lines 46 approximately thirty degrees to form the lateral walls 36. The sheet metal is folded an opposite direction of the other folds along a pair of wing fold lines 48 to approximately ninety degrees to create the wings 32.

Reference is now made to FIG. 4A-4E, which illustrate various views of the joist 16. The joist 16 is generally box shaped and rectangular in profile. The joist 16 may be a generally closed box shape. The joist 16 includes a deck support wall 50 and a lower wall 52 opposite the deck support wall 50. A pair of opposed lateral walls 54 span between the deck support wall 50 and the lower wall 52. At one end of the tube joist 16 a through hole 55 is formed through the pair of opposed lateral walls 54. Plumbing lines, electrical wires, data wires, and the like may be run through the through holes 55 to conveniently dispose such lines safely beneath the surface of the deck without additional brackets etc.

According to certain embodiments, a plurality of weep holes 56 are formed in either the deck support wall 50, the lower wall 52 or both. The weep holes 56 are large enough to allow moisture to drain through the weep holes 56 and out of the interior of the joist 16. According to one embodiment, a twenty foot joist 16 may include four weep holes 56 equally spaced apart from each other approximately sixty inches where the weep holes 56 are formed in the lower surface 52 such that gravity causes moisture from the interior of the joist 16 to drain out of the weep holes 56. The joist 16 has a height of approximately six inches, which allows it to fit snuggly over the joist bracket 14 and between the overhang portion 24 and the joist support wall 22 of the ledger 12.

The box-shape of the joist 16 results in a joist that is stronger than a conventional c-shaped metal joist. In assembling the deck framing system 10, the joist 16 is received over the joist support portion 34 of the joist bracket 14. The lower cut-away 42 facilitates ease of placement of the joist 14 during assembly. The lower cut-away 42 allows the joist 16 to be initially placed over the joist support portion 34 at a downward sloping angle from horizontal during initial positioning before the joist 16 is seated over the support portion 34 of the bracket in its assembled horizontal position. Fasteners (not shown) are received through the opposed lateral walls 54 of the joist 16 and the lateral portions 36 of the joist bracket 14 to further secure the joist 16 to the joist bracket 14.

Figure 5A:
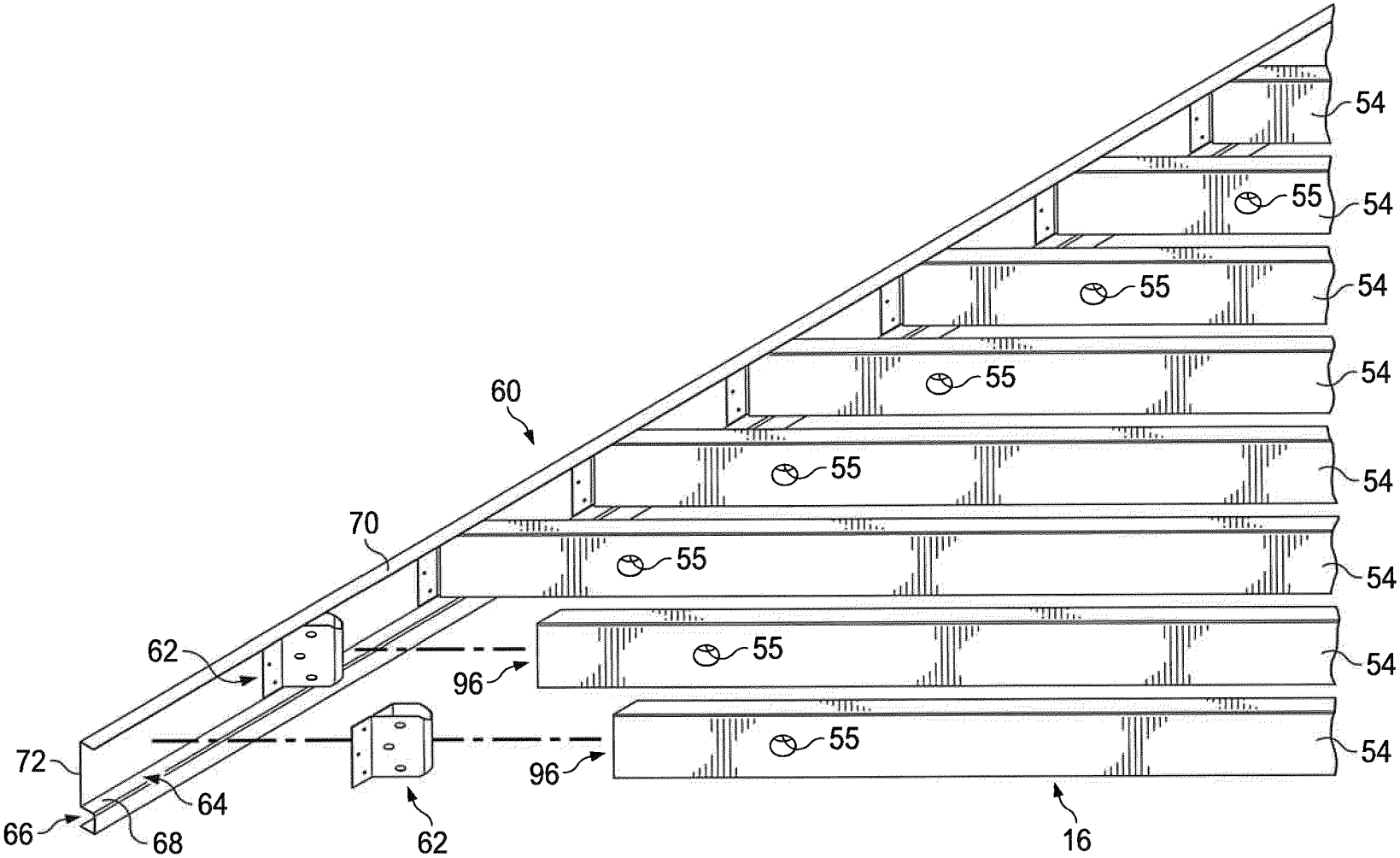
FIGS. 5A and 5B are isometric and plan views respectively of an alternate embodiment of a deck framing system facilitating tube joist attachment at a non-square angle.
Figure 5B:
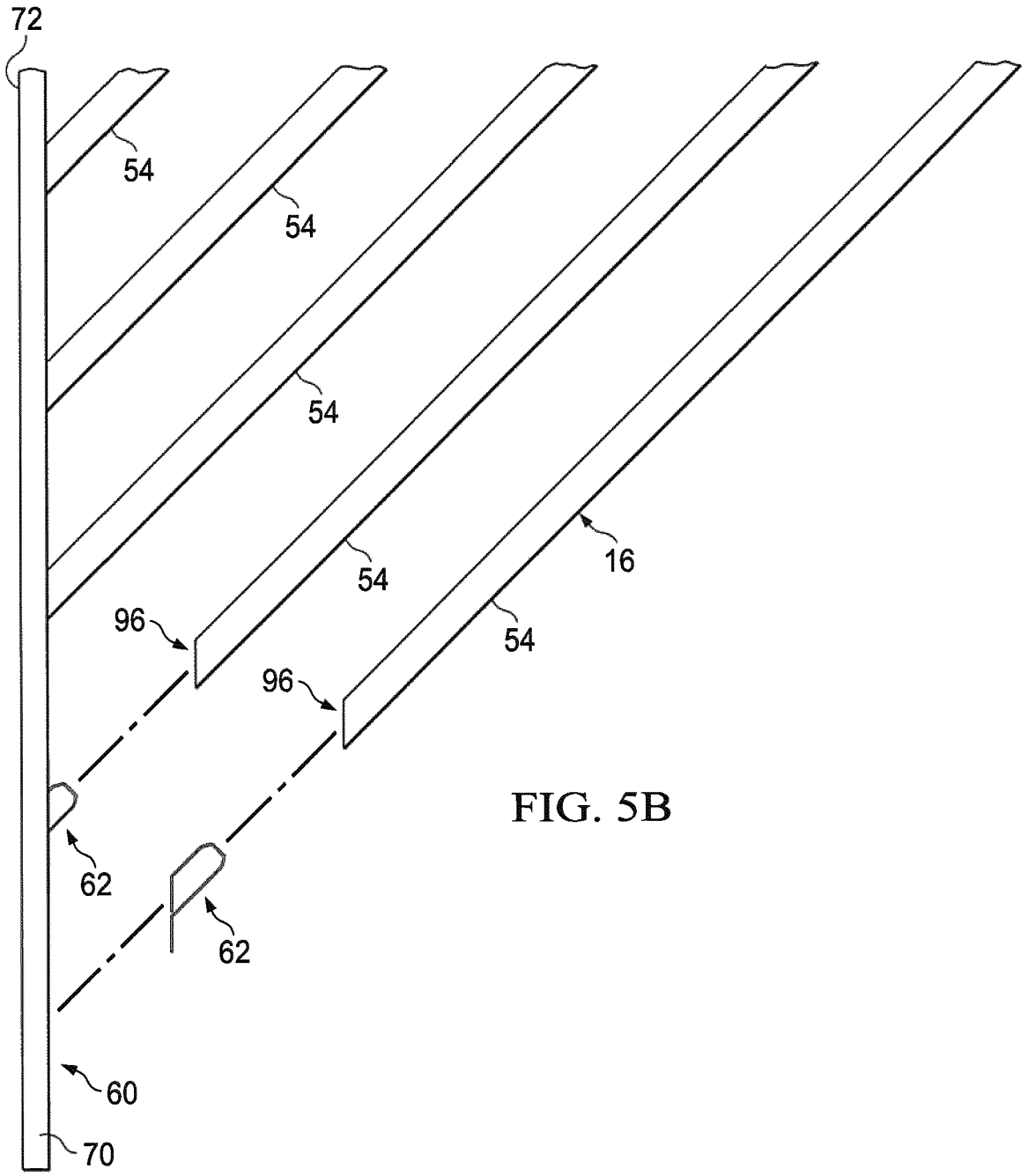

Reference is made to FIGS. 5A and 5B, which illustrate an alternate embodiment of an S-ledger according to the teachings of the present disclosure. As shown in the overhead, plan view of FIG. 5B, the tube joists 16 are attached to a blank ledger 60 at a fixed angle, for example 45 degrees. The ledger 60 is blank in that it does not include slots spaced apart along its length. A fixed angle joist support bracket 62 is attached at any desired position along the blank ledger 60. The fixed angle joist support bracket 62 is attached to the blank ledger 60 using any suitable fasteners, such as metal screws and the like, as described in further detail below.

The blank S-ledger includes similar features as the slotted S-ledger 12 described above with respect to FIGS. 1A-2D. The blank ledger 60 has a generally s-shaped profile. The s-shape is generally formed by an upper c-shaped portion 64 and a lower c-shaped portion 66. A joist support wall 68 is disposed generally horizontal and forms a lower part of the upper c-shaped portion 64 and an upper part of the lower c-shaped portion 66. The upper c-shaped portion 64 includes an overhang 70, a web wall 72 extending downward from the overhang portion 70 and the joist support wall 68 opposite the web portion 72 from the overhang portion 70. An opening of the "c" of the upper c-shaped portion 64 faces opposite an opening of the "c" of the lower c-shaped portion 66.

The blank ledger 60 is attached to a structure, such as a foundation, bricks, wall studs, and the like of a home. According to certain embodiments, a suitable fastener, such as a screw is received through the web portion 72. Alternatively, a suitable fastener may be received through a preformed hole in the web portion 72. Such preformed holes may be similar to those described above with respect to the slotted ledger 12.

According to one embodiment, a height of the web portion 72 is slightly over six inches. This may be an improvement over conventional ledgers where a height of a web portion is approximately 10 inches. The reduced height to approximately six inches allows the upper c-shaped portion 64 supporting the tube joists 16 to be more rigid and less likely to bend under the weight of the deck supported by the tube joists 16.

The lower c-shaped portion 66 provides an area underneath the joists 16 to run electrical wiring and the like and provides clearance beneath the tube joists 16. The lower c-shaped portion 66 also increases the strength of the blank ledger 60 and also provides a spring force when the blank ledger 60 is loaded.

The blank ledger 60 may be generally formed by sheet metal forming methods known in the art, such as bending a flat piece of light gauge steel in to the s-shape profile. A height of the blank s-shaped ledger 60 is approximately eight inches. The blank ledger 60 may be formed in any suitable length, for example the blank ledger 60 may be 20 feet in length.

Figure 6A:
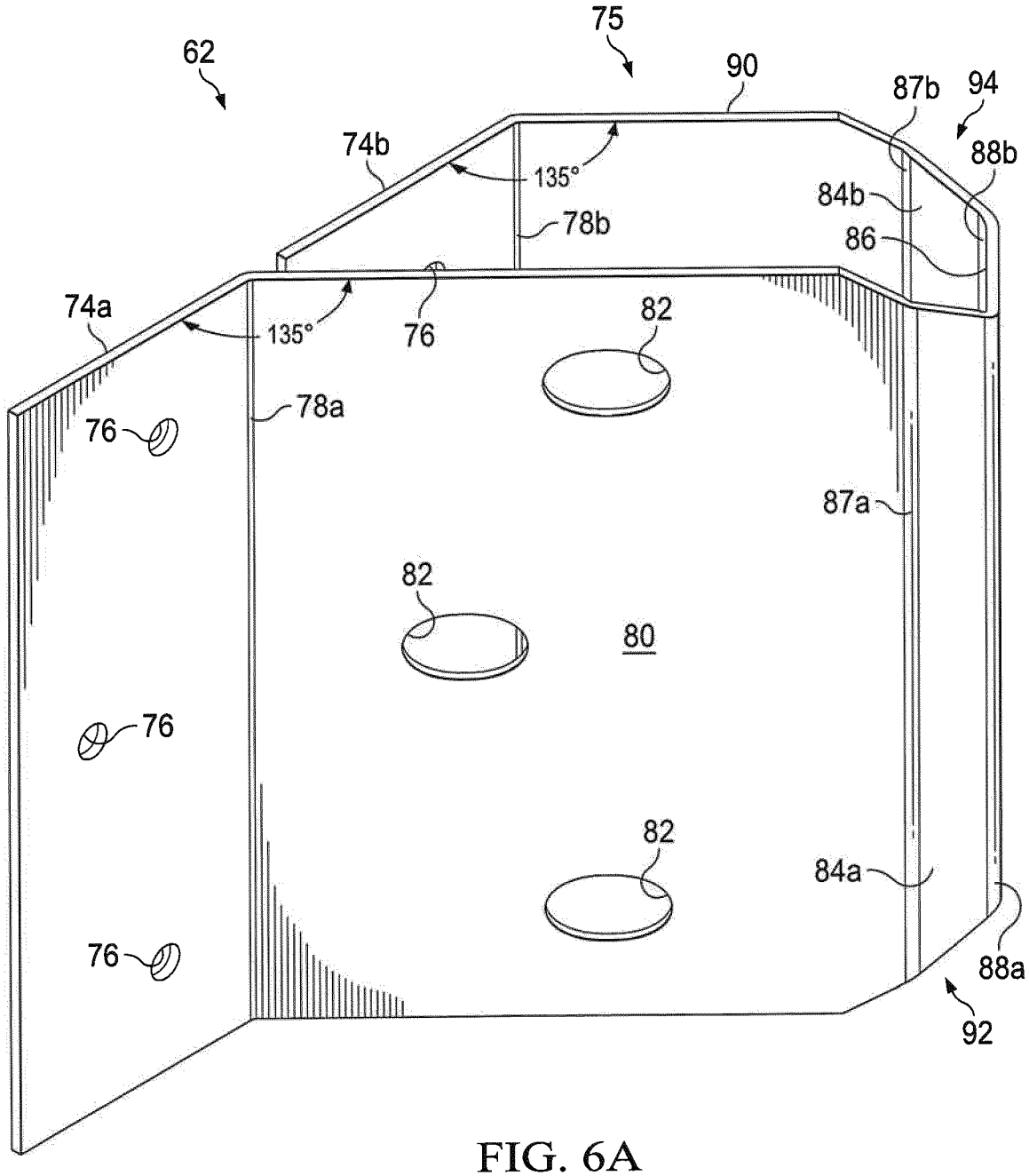
FIGS. 6A and 6B are isometric and elevation views respectively of the fixed angle joist support bracket shown in FIGS. 5A and 5B.
Figure 6B:
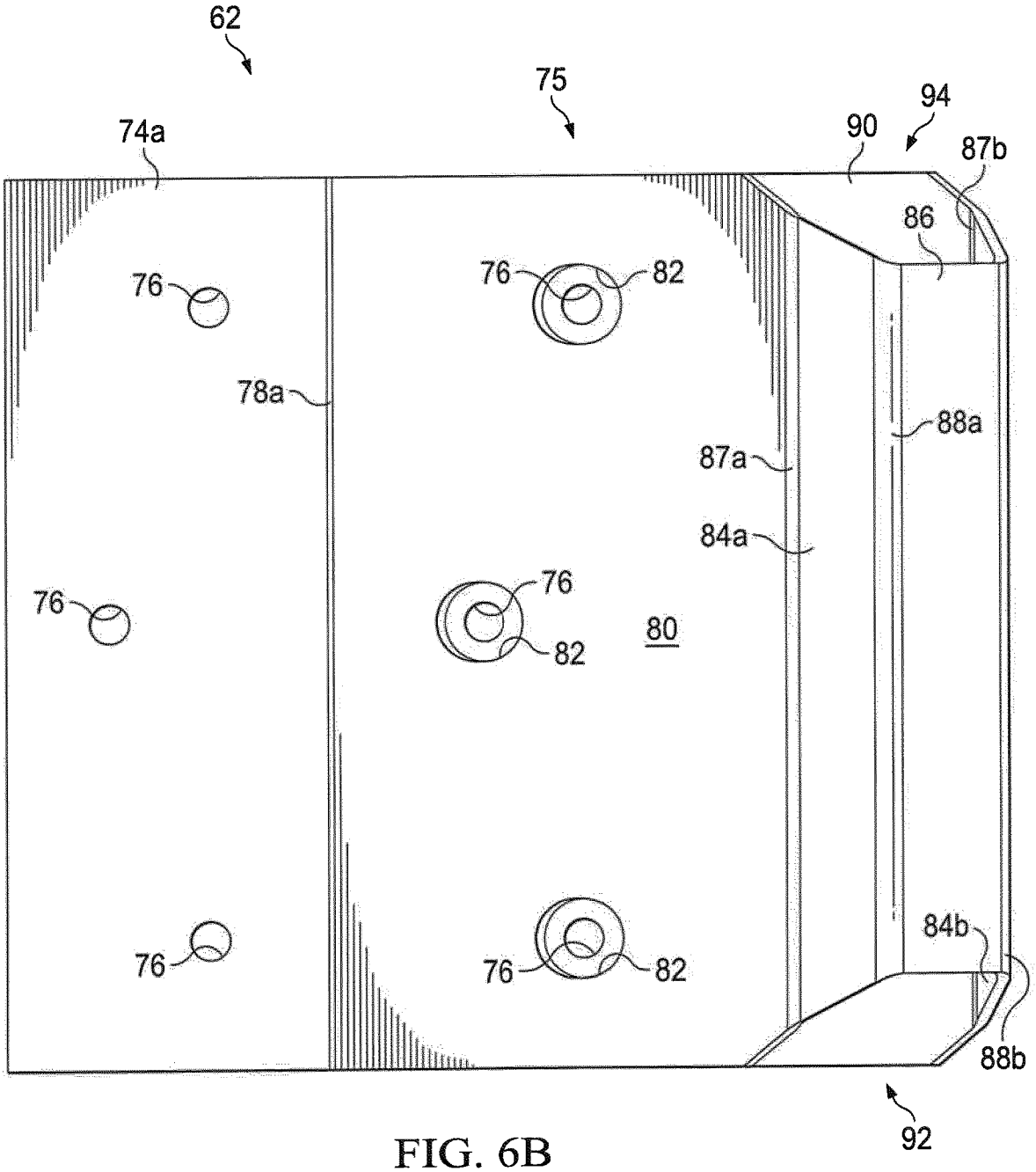

Reference is made to FIGS. 6A and 6B, which are an isometric view and a side, elevation view respectively of the fixed angle joist support bracket 62. The fixed angle joist support bracket 62 can be attached to the blank ledger 60 at any desirable location along the length of the blank ledger 60 because the fixed angle joist support bracket 62 is not received in a preformed slot, as described above with respect to the slotted ledger 12 and the square joist support bracket 14. Upon attachment to the blank ledger 60, the fixed angle joist support bracket 62 supports a tube joist 16 that extends from the blank ledger 60 at a fixed, non-square (other than 90 degrees) angle. According to certain embodiments, the tube joist 16 supported by the fixed angle joist support bracket 62 forms a 45 degree angle with the blank ledger 60. One skilled in the art will recognize that such angle is not limited to 45 degrees, and may be any suitable non-square angle.

The fixed angle joist support bracket 62 includes ledger attachment wings 74*a*, 74*b* and a joist support portion 75 similar to the square joist support bracket 14. The ledger attachment wings 74*a*, 74*b* are received between the overhang portion 70 and the joist support wall 68 of the blank ledger 60. Rear faces of the ledger attachment wings 74*a*, 74*b* are secured to the web wall 72 of the blank ledger 60. A plurality of preformed holes 76, for example three, formed in respective ledger attachment wings 74*a*, 74*b*, receive fasteners to secure the ledger attachment wings 74*a*, 74*b* to the web wall 72 of the blank ledger 60.

A joist attachment wall or portion 80 extends at a fixed angle from the ledger attachment wing 74*a*. A fold line 78*a* is disposed between the ledger attachment wing 74*a* and the joist attachment portion 80. A fold line 78*b* is disposed between the ledger attachment wing 74*b* and a lateral wall 90. The fold lines 78*a*, 78*b* are created using conventional sheet metal forming techniques, such as bending a flat piece of sheet metal, for example light gauge galvanized steel to the desired angle, for example 45 degrees (135 degrees with respect to the ledger attachment wall).

The joist attachment portion 80 also includes preformed access holes 82 that allow access to the preformed holes 76 in the ledger attachment wing 74*b*. The access holes 82 have an elliptical shape with axes long enough to allow the fastening tools of an installer to pass through the joist attachment wall 80 and be received in the through holes 76 formed in the ledger attachment wing 74*b*, so the wing 74*b* is firmly secured to the web portion 72 of the blank ledger 60. The through holes 76 in the ledger attachment wings 74*a*, 74*b* are disposed similar to the configuration of the through holes 30 in the slotted ledger 12, as described in further detail above in connection with FIG. 2D. Fasteners, such as metal screws, penetrate the lateral wall 54 of the tube joist 16 and further penetrate the joist attachment portion 80.

An angled wall 84*a* is bent at approximately 35 degrees from the joist attachment wall 80. A bracket web wall 86 is bent approximately 55 degrees from the angled wall 84*a*. A second angled wall 84*b* is disposed on the opposite side of the bracket web wall 86 from the first angled wall 84*a*. Similar to the square joist support bracket 14 shown and described with respect to FIGS. 3A-3D, the bracket web wall 86 is received squarely within the length of the tube joist 16. The second angled wall 84*b* is bent approximately 35 degrees from a lateral wall or portion 90. The joist attachment wall 80, the angled walls 84*a*, 84*b*, the bracket web portion 86, and the lateral wall 90 make up the joist support portion 75 and collectively are received by the tube joist 16. As such, the joist attachment wall 80, the angled walls 84*a*, 84*b*, the bracket web portion 86, and the lateral wall 90 support one end of the tube joist 16. Importantly, the tube joist may be fitted over the joist support portion 75 (the joist attachment wall 80, the angled walls 84*a*, 84*b*, the bracket web portion 86, and the lateral wall 90) and receive fasteners through the lateral walls 54 of the tube joist while the joist is in the proper deck frame position.

A flat piece of sheet metal is folded to form the fixed angle joist support bracket 62. The sheet metal is folded along angled portion fold lines 88*a*, 88*b* approximately 55 degrees with a radius of approximately 0.1 inches to form the respective angled portions 84*a*, 84*b*. The sheet metal is folded along a pair of lateral portion fold lines 87*a*, 87*b* approximately thirty-five degrees to form the joist attachment wall 80 and the lateral wall 90.

The fixed angle joist support bracket 62 is bi-directional in that it can be secured to the blank ledger with the joist support portion 75 extending to the left or to the right at the fixed angle. Such bi-directionality is at least partially facilitated by a lower cut-away 92 and an upper cut away 94. Each of the upper and lower cut-aways 92, 94 is formed by removing material from a lower portion of the bracket web 86, the angled portions 84*a*, 84*b*, the joist attachment wall 80, and the lateral wall 90. According to certain embodiments, the cut-aways 92, 94 are approximately thirty degrees from horizontal and extend into the fixed angle joist bracket 62 approximately one inch. As described in more detail below, the cut-aways 92, 94 facilitate placement of the tube joist 16 over the joist support portion 75 of the fixed angle joist support bracket 62 such that the tube joist 16 extends at the fixed angle either to the left or the right away from the blank ledger 60.

In assembling the deck framing system, the tube joist 16 is received over the joist support portion 75 of the fixed angle joist support bracket 62. The tube joist 16 is cut at its end at a 45 degree angle such that it has an angled end 96. The angled end 96 fits over the joist support portion 75 of the fixed angle joist support bracket 62 and a face at the angled end 92 is parallel to the web portion 72 of the blank ledger 60. The lower cut-away 92 (and the upper cut-away 94, when the joist support portion 75 extends leftward from the ledger at the fixed angle) facilitates ease of placement of the tube joist 16 during assembly. The lower cut-away 92 allows the tube joist 16 to be initially placed over the joist support portion 75 at a downward sloping angle from horizontal during initial positioning before the tube joist 16 is seated over the joist support portion 75 of the fixed angle bracket 62 in its assembled horizontal position. Fasteners (not shown) are received through the lateral wall 54 of the tube joist 16 and the joist attachment wall 80 of the fixed angle joist support bracket 62 to further secure the tube joist 16 to the fixed angle joist support bracket 62. The joist support portion 75 supports the tube joist 16 in position to receive the fasteners. This simplifies assembly of a tube joist 16 at a non-square angle with a blank ledger 60 and represents an improvement over conventional brackets used to frame decks.

Figure 7:
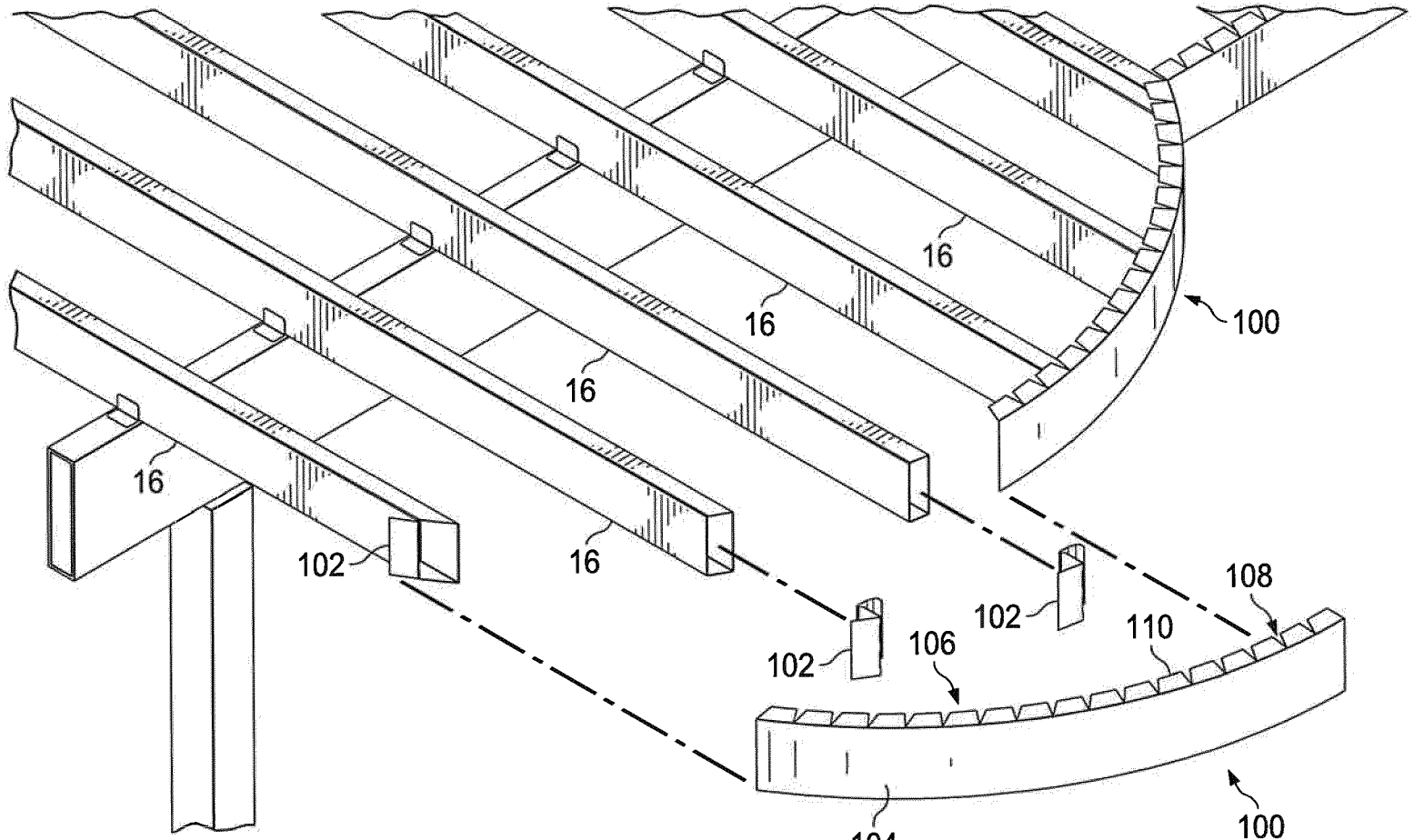
FIG. 7 is an isometric, partially exploded view of a deck framing system employing adjustable angle brackets and arcuate rim joists.

Reference is made to FIG. 7, which is an exploded, isometric view of an arcuate perimeter portion of a deck frame. The arcuate perimeter is formed by a rim joist 100 and a plurality of adjustable angle brackets 102 according to the teachings of the present disclosure. The ends of the tube joists 16 opposite the illustrated ends are supported by respective square joist support brackets 14 coupled to a slotted ledger 12. The rim joist 100 is generally L-shaped and includes a web wall 104 and an overhang portion 106. The rim joist 100 is formed of light gauge steel, for example, light gauge galvanized steel.

The rim joist 100 may optionally be powder coated such that it has a more pleasing aesthetic appearance over the appearance of galvanized steel. In addition, all components of all embodiments of the deck framing system optionally may be powder coated to improve the appearance of the components over the appearance of galvanized steel including the slotted ledger 12, the tube joists 16, the square joist support bracket 14, the blank ledger 60, the fixed angle joist support bracket 62, and the adjustable angle bracket 102.

The rim joist 100 is bendable such that it can be formed into an arcuate shape. The bending of the rim joist 100 is facilitated by notches 108 in the overhang portion 106. The notches 108 are equally spaced apart from each other along the length of the overhang portion 106 and tabs 110 are formed between adjacent notches 108. The tabs 110 are disposed perpendicularly to the web wall 104 of the rim joist 100. According to certain embodiments, the web wall 104 of the rim joist 100 is the same height as the web walls of the slotted ledger 12 and the blank ledger 60. The rim joist 100 is manufactured and purchased as a straight generally L-shaped piece of sheet metal that includes the web wall 104, the notches 108, and the tabs 110 (see FIG. 9). The installer bends the rim joist 100 to the desired curvature for the deck perimeter. As shown in FIG. 7, the curvature is created by end faces of the tube joists 16 that are disposed in an arc. As explained in more detail below, the end faces of the tube joists 16 are cut to an appropriate angle to accommodate joining the rim joist 100 to the end faces.

The adjustable angle bracket 102 is attached at any location along the length of the rim joist 100, and more specifically to the web wall 104 of the rim joist 100. The bendability of the rim joist 100 together with the adjustable angle of the adjustable angle bracket 102 allows a deck to have an aesthetically pleasing curved perimeter portion.

Figure 8A:
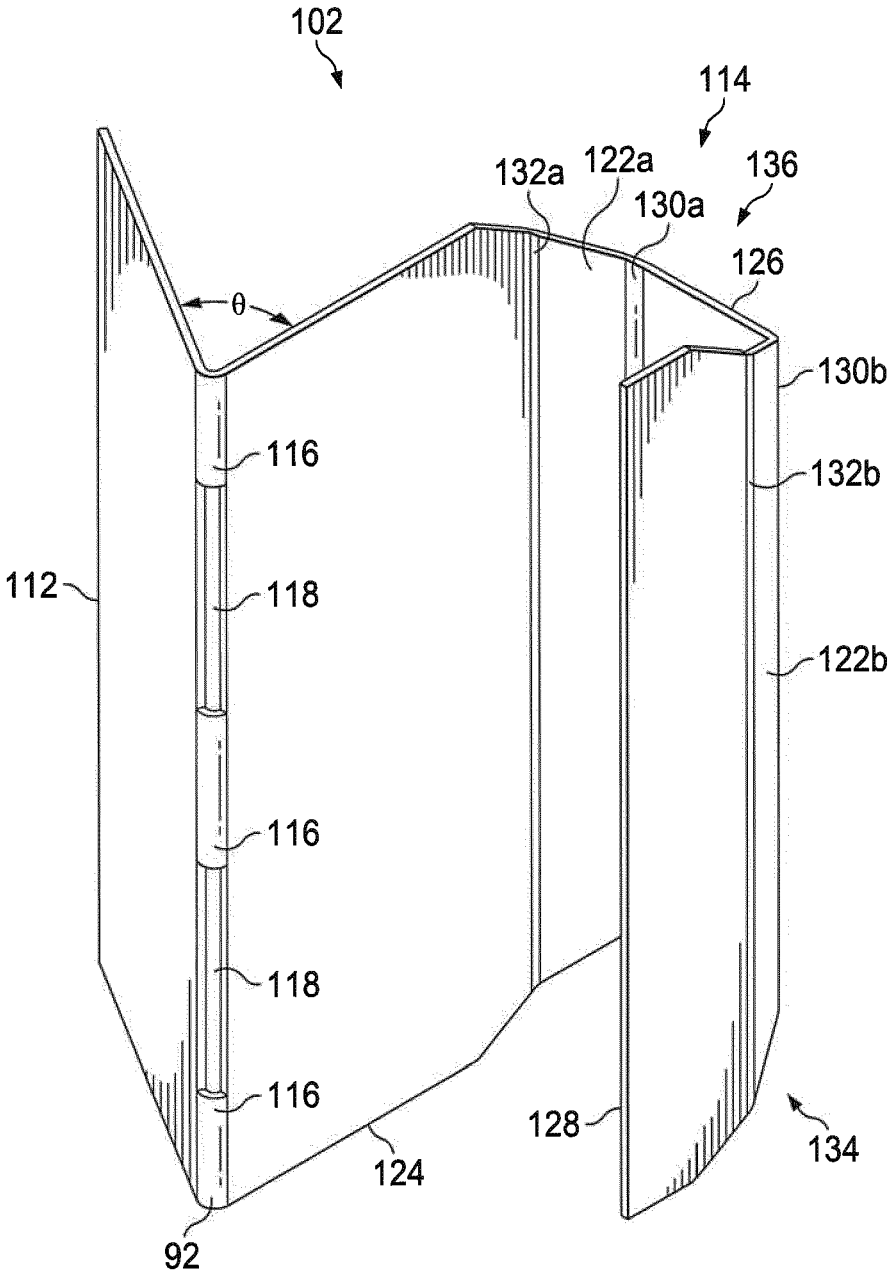
FIGS. 8A-8E are various views of the adjustable angle bracket shown in FIG. 7.
Figure 8B:
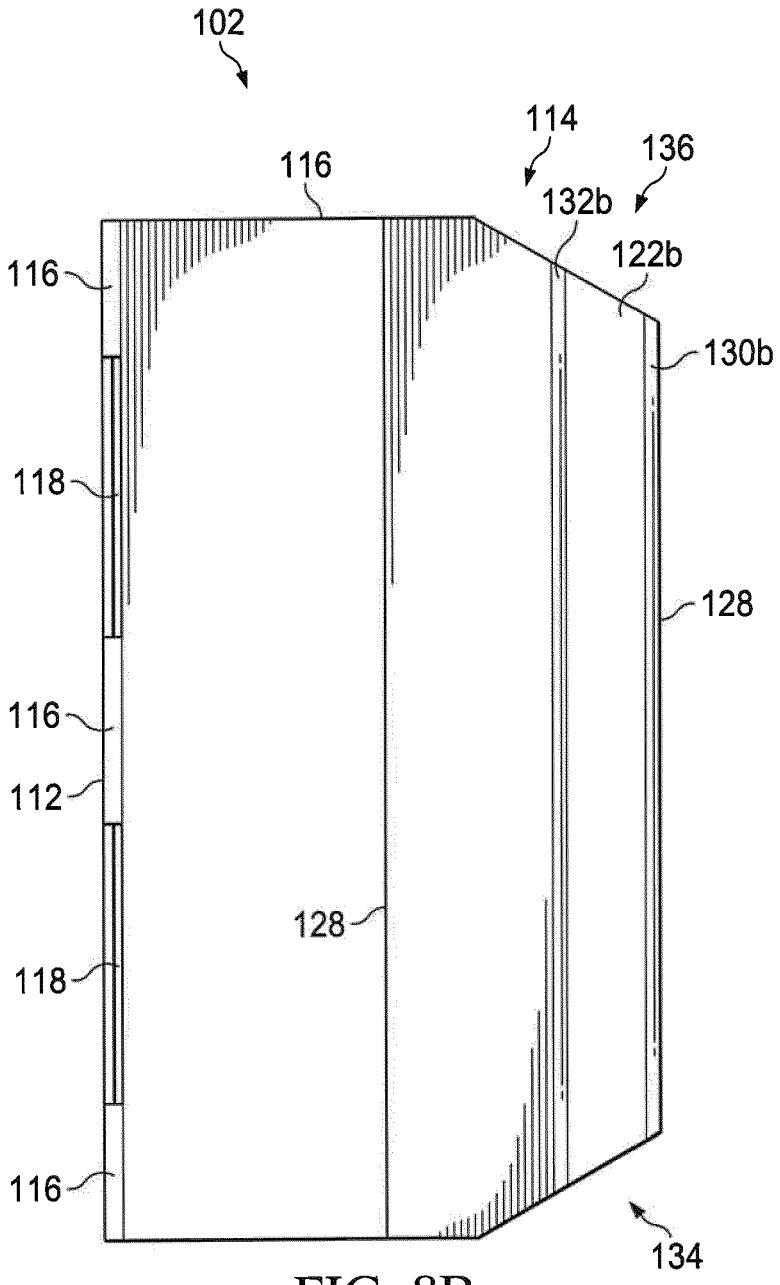

Reference is made to FIGS. 8A-8E together with FIG. 7, which show isometric, elevation, and plan views of the adjustable angle bracket 102. FIG. 8A shows the adjustable angle bracket 102 adjusted (i.e. bent) to an angle theta; FIG. 8B is an elevation view of the adjustable angle bracket 102. The adjustable angle bracket 102 includes a rim joist attachment wing 112 and a tube joist received portion 114. A bendable junction portion 116 is formed by pieces of sheet metal separated by voids 118 disposed at the intersection of the tube joist received portion 114 and the rim joist attachment wing 112. The reduced material at the bendable junction 116 resulting from the voids 118 allow the tube joist received portion 114 to be bent by hand or using hand tools to a suitable angle theta As such, the angle theta of the tube joist received portion 114 with respect to the rim joist attachment wing 112 and therefore the rim joist 100 is adjustable. The bendable junction 116 functions similar to a living hinge.

Figure 8C:
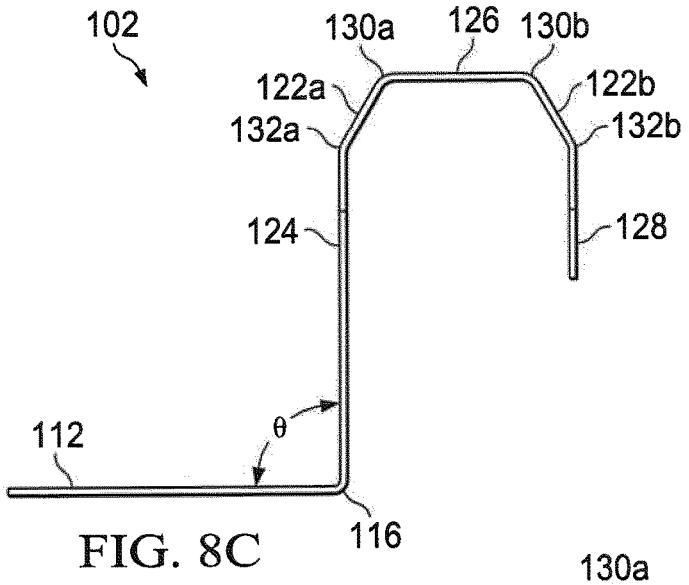
Figure 8D:
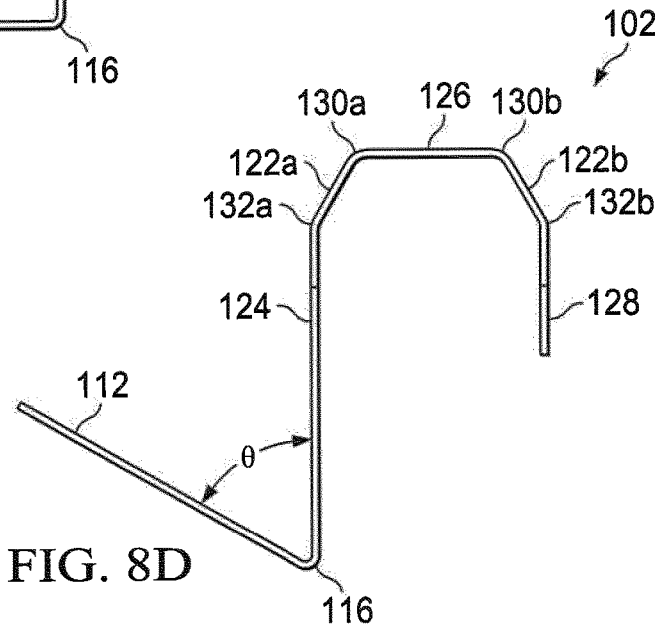
Figure 8E:
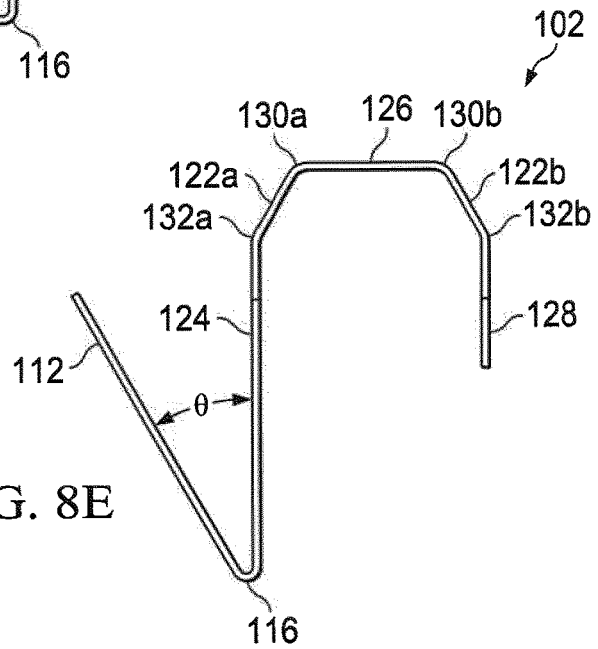

The angle theta is adjustable from approximately 30 degrees to 90 degrees to allow installation of a variety of curved rim joists. For example, as shown in FIG. 8C theta is adjusted to equal 90 degrees to allow the tube joist received portion to be received squarely within a square cut tube joist 16. FIG. 8D shows the angle theta bent to 60 degrees to allow the tube joist received portion 114 to be received in a tube joist 16 with a shallow angle cut tube joist end. As shown in FIG. 8E the angle theta is bent to 30 degrees to allow the tube joist received portion 114 to be received in a steeper angle cut tube joist 16. Accordingly, a perimeter arc, as shown in FIG. 7 is formed using multiple adjustable angle brackets 102 and at least one (two shown) bent rim joist 100.

The adjustable angle bracket 102 includes the rim joist attachment wing 112 that is secured to the web wall 104 and is disposed beneath the overhang portion 106. Suitable fasteners, such as metal screws, penetrate the rim joist attachment wing 112 and the web wall 104 of the rim joist 100 to secure the adjustable angle bracket 102 to the rim joist 100. Alternatively, preformed holes may be made in the rim joist attachment wing 112, which receive fasteners that penetrate the web wall 104 of the rim joist 100.

An angled wall 122*a* is bent at approximately 35 degrees from a tube joist attachment wall 124. A bracket web wall 126 is bent approximately 55 degrees from the angled portion 122*a*. A second angled portion 122*b* is disposed on the opposite side of the bracket web wall 126 from the first angle portion 122*a*. Similar to the square joist support bracket 14 shown and described with respect to FIGS. 3A-3D, and the fixed angle joist support bracket 62, the bracket web wall 126 is received within the length of the tube joist 16. The second angled portion 122*b* is bent approximately 35 degrees from a lateral wall or portion 128. The tube joist attachment wall 124, the angled walls 122*a*, 122*b*, the bracket web wall 126, and the lateral wall 128 make up the tube joist received portion 114 and are collectively received by the tube joist 16. Fasteners, such as metal screws, penetrate the lateral wall 54 of the tube joist 16 and further penetrate the tube joist attachment wall 124.

A flat piece of sheet metal is folded to form the adjustable angle bracket 102. The sheet metal is folded along angled portion fold lines 130*a*, 130*b* approximately 55 degrees with a radius of approximately 0.1 inches to form the respective angled portions 122*a*, 122*b*. The sheet metal is folded along a pair of lateral portion fold lines 132*a*, 132*b* approximately thirty-five degrees to form the tube joist attachment wall 124 and the lateral wall 128.

The adjustable angle bracket 102 is bi-directional in that it can be secured to the rim joist 100 the tube joist received portion 114 extending to the left or to the right at the adjustable angle theta. Such bi-directionality is at least partially facilitated by a lower cut-away 134 and an upper cut away 136. Each of the upper and lower cut-aways 134, 136 is formed by removing material from a lower portion of the bracket web 126, the angled portions 122*a*, 122*b*, the tube joist attachment wall 124, and the lateral wall 128. According to certain embodiments, the cut-aways 134, 136 are approximately thirty degrees from horizontal and extend into the adjustable angle bracket 102 approximately one inch, similar to the cut-away shown in FIG. 3D. The cut-aways 134, 136 facilitate placement of the tube joist 16 over the tube joist received portion 114 such that the tube joist 16 extends at the adjustable angle theta either to the left or the right away from the rim joist 100.

Regardless whether the tube joist received portion 114 is inserted into the tube joist 16 first or the rim joist attachment wing 112 is secured to the web portion 104 of the rim joist first, fasteners (not shown) are received through the lateral wall 54 of the tube joist 16 and the joist attachment wall 124 of the adjustable angle bracket 102 to secure the tube joist 16 to the adjustable angle bracket 102. The rim joist is curved to the desired curvature.

Figure 9:
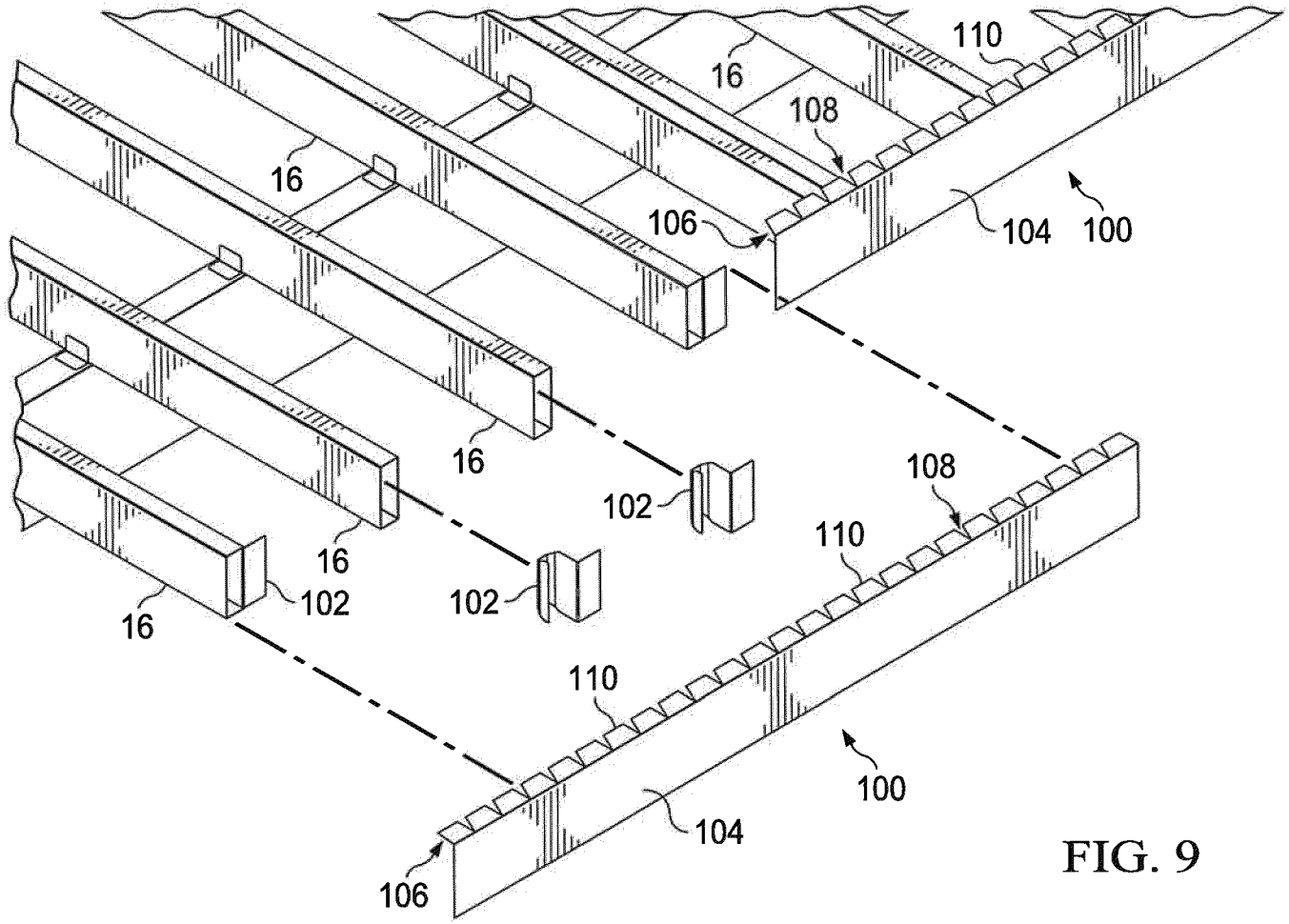
FIG. 9 is an isometric, partially exploded view of a deck framing system employing adjustable angle brackets and straight, non-arcuate rim joists.

Alternatively, as shown in FIG. 9, the rim joist 100 may be installed in a straight configuration. In this embodiment, the adjustable angle theta is approximately 90 degrees, and a plurality of adjustable angle brackets 102 are attached to the web portion 104 of the rim joist 100. The tube joist received portions 114 are received within the ends of square-cut tube joists 16 and the fasteners are received through the lateral walls 54 of the tube joist 16 and into the tube joist attachment wall 124.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A joist support bracket, comprising:

a first lateral wall;

a second lateral wall disposed opposite the first lateral wall;

a first wing wall extending generally perpendicularly from the first lateral wall;

a second wing wall extending generally perpendicularly from the second lateral wall, the first wing wall and the second wing wall extending away from each other;

a web wall;

a first angled wall disposed between the web wall and the first lateral wall;

a first fold line disposed between the web wall and the first angled wall;

a second fold line disposed between the first angled wall and the first lateral wall;

a second angled wall disposed between the web wall and the second lateral wall;

a third fold line disposed between the web wall and the second angled wall; and a fourth fold line disposed between the second angled wall and the second lateral wall;

wherein the first lateral wall is biased to form a first non-perpendicular angle between the web wall and the first lateral wall.

2. The joist support bracket of claim 1 wherein the second lateral wall is biased to form a second non-perpendicular angle between the web wall and the second lateral wall.

3. The joist support bracket of claim 2 wherein the first non-perpendicular angle is approximately 95 degrees and the second non-perpendicular angle is approximately 95 degrees.

4. The joist support bracket of claim 1 wherein the first lateral wall, the second lateral wall, the first wing wall, the second wing wall, and the web wall are each portions of a piece of sheet metal.

5. The joist support bracket of claim 4 wherein the piece of sheet metal is galvanized steel.

6. The joist support bracket of claim 5 wherein the piece of sheet metal has a thickness in a range of 0.05-0.10 inches.

7. The joist support bracket of claim 6 wherein the thickness is 0.08 inches.

8. The joist support bracket of claim 1 wherein the first non-perpendicular angle is approximately 95 degrees.

9. The joist support bracket of claim 1 wherein the web wall, the first and second angled walls and the first and second lateral walls define an angled cut-away.

10. A method of forming a joist support bracket, comprising:

providing a piece of sheet metal;

bending the piece of sheet metal to form:

a first lateral wall;

a second lateral wall disposed opposite the first lateral wall;

a first wing wall extending generally perpendicularly and outwardly from the first lateral wall;

a second wing wall extending generally perpendicularly and outwardly from the second lateral wall, the first wing wall and the second wing wall extending away from each other;

a web wall;

a first angled wall disposed between the web wall and the first lateral wall; and a second angled wall disposed between the web wall and the second lateral wall;

wherein the first lateral wall is biased to form a first non-perpendicular angle between the web wall and the first lateral wall.

11. The method of claim 10 wherein the piece of sheet metal is galvanized steel.

12. The method of claim 11 wherein the piece of sheet metal has a thickness in a range of 0.05-0.10 inches.

13. The method of claim 12 wherein the thickness is 0.08 inches.

14. A joist support bracket, comprising:

a first lateral wall;

a second lateral wall disposed opposite the first lateral wall;

a first wing wall extending generally perpendicularly and outwardly from the first lateral wall;

a second wing wall extending generally perpendicularly and outwardly from the second lateral wall, the first wing wall and the second wing wall extending away from each other; and a web wall;

wherein the first lateral wall is biased to form a first non-perpendicular angle between the web wall and the first lateral wall and second lateral wall is biased to form a second non-perpendicular angle between the web wall and the second lateral wall;

wherein the first lateral wall, the second lateral wall, the first wing wall, the second wing wall, and the web wall are each portions of a piece of sheet metal.

15. The joist support bracket of claim 14 wherein the piece of sheet metal is a piece of galvanized steel.

16. The joist support bracket of claim 15 wherein the piece of sheet metal has a thickness in a range of 0.05-0.10 inches.

17. The joist support bracket of claim 16 wherein the thickness is 0.08 inches.

18. A joist support bracket, comprising:

a first lateral wall;

a second lateral wall disposed opposite the first lateral wall;

a first wing wall extending generally perpendicularly from the first lateral wall;

a second wing wall extending generally perpendicularly from the second lateral wall, the first wing wall and the second wing wall extending away from each other;

a web wall;

a first angled wall disposed between the web wall and the first lateral wall; and a second angled wall disposed between the web wall and the second lateral wall;

wherein the first lateral wall is biased to form a first non-perpendicular angle between the web wall and the first lateral wall; and wherein the first angled wall is disposed at a 125 degree angle with the web wall and the second angled wall is disposed at a 125 degree angle with the web wall.

* * * * *